US012264027B2

(12) United States Patent
Urrutia Nebreda et al.

(10) Patent No.: US 12,264,027 B2
(45) Date of Patent: Apr. 1, 2025

(54) MEDIA LOADING DEVICES

(71) Applicant: Hewlett-Packard Development Company, L.P., Spring, TX (US)

(72) Inventors: Martin Urrutia Nebreda, Sant Cugat del Valles (ES); Joan Marti Velasco Figueras, Sant Cugat del Valles (ES); Antonella de Ceano-Vivas Zarzoso, Sant Cugat del Valles (ES); Jorge Porras Martinez, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 630 days.

(21) Appl. No.: 17/616,039

(22) PCT Filed: Jul. 31, 2019

(86) PCT No.: PCT/US2019/044431

§ 371 (c)(1),
(2) Date: Dec. 2, 2021

(87) PCT Pub. No.: WO2021/021175

PCT Pub. Date: Feb. 4, 2021

(65) Prior Publication Data

US 2022/0297968 A1 Sep. 22, 2022

(51) Int. Cl.
*B65H 23/00* (2006.01)
*B65H 23/04* (2006.01)

(52) U.S. Cl.
CPC ..... *B65H 23/005* (2013.01); *B65H 23/046* (2013.01); *B65H 2301/415185* (2013.01); *B65H 2301/4176* (2013.01)

(58) Field of Classification Search
CPC ..... B65H 23/005; B65H 23/046; B65H 2301/4176
See application file for complete search history.

(56) References Cited

U.S. PATENT DOCUMENTS 5,882,130 A 3/1999 Kumazaki et al.
5,962,861 A * 10/1999 Fowler ..... B65H 43/00 177/1
6,435,641 B1 8/2002 Tung et al.
6,604,017 B1 8/2003 Richardson et al.
6,905,269 B2 6/2005 Hansburg
(Continued)

FOREIGN PATENT DOCUMENTS

CN 1133786 A 10/1996
CN 103171313 A 6/2013
(Continued)

*Primary Examiner* — Sang K Kim
(74) *Attorney, Agent, or Firm* — Jordan IP Law, LLC

(57) ABSTRACT

According to an example, a media loading device may comprise a motor and a leading-edge sensor. The motor may rotate a media roll having a leading-edge in a winding direction and unwinding direction, the motor being controlled by a processor. The leading-edge sensor may comprise a pivot arm and a detecting element. The pivot arm may contact the media roll and the detecting element may issue a leading-edge presence signal to the processor upon contact between the detecting element and the leading-edge occurs.

10 Claims, 4 Drawing Sheets

(56) References Cited

U.S. PATENT DOCUMENTS

| | | | | |
|---|---|---|---|---|
| 7,357,387 | B2 | 4/2008 | Asada | |
| 8,752,829 | B1 * | 6/2014 | Uehling | B41J 11/0095 271/265.01 |
| 9,004,640 | B2 | 4/2015 | Ishikawa et al. | |
| 2002/0154205 | A1 | 10/2002 | Kaya | |
| 2013/0161369 | A1 | 6/2013 | Chen | |
| 2018/0257407 | A1 | 9/2018 | Daikoku et al. | |
| 2018/0257408 | A1 | 9/2018 | Eiyama et al. | |

FOREIGN PATENT DOCUMENTS

| | | | |
|---|---|---|---|
| EP | 0395023 | A2 | 10/1990 |
| JP | 09-048538 | A | 2/1997 |
| JP | 2002144654 | | 5/2002 |
| JP | 2002-179308 | A | 6/2002 |
| JP | 2002-308525 | A | 10/2002 |
| JP | 2005288955 | | 10/2005 |

* cited by examiner

MEDIA LOADING DEVICES

BACKGROUND

Media loading devices are used in many types of machines including and not limited to printers, scanners, cutters, etc. In some examples of media loading devices using a media roll, a user may need to manually find a leading-edge of the media roll in order to load the media roll. In the case the leading-edge is in the wrong position, the media loading device will not perform the loading operations on the media roll properly. It is hereby disclosed a media loading device in which the leading-edge may be automatically found by performing several loading operations over the media roll.

BRIEF DESCRIPTION OF DRAWINGS

Features of the present disclosure are illustrated by way of example and are not limited in the following figure(s), in which like numerals indicate like elements, in which.

DETAILED DESCRIPTION

Figure 1:
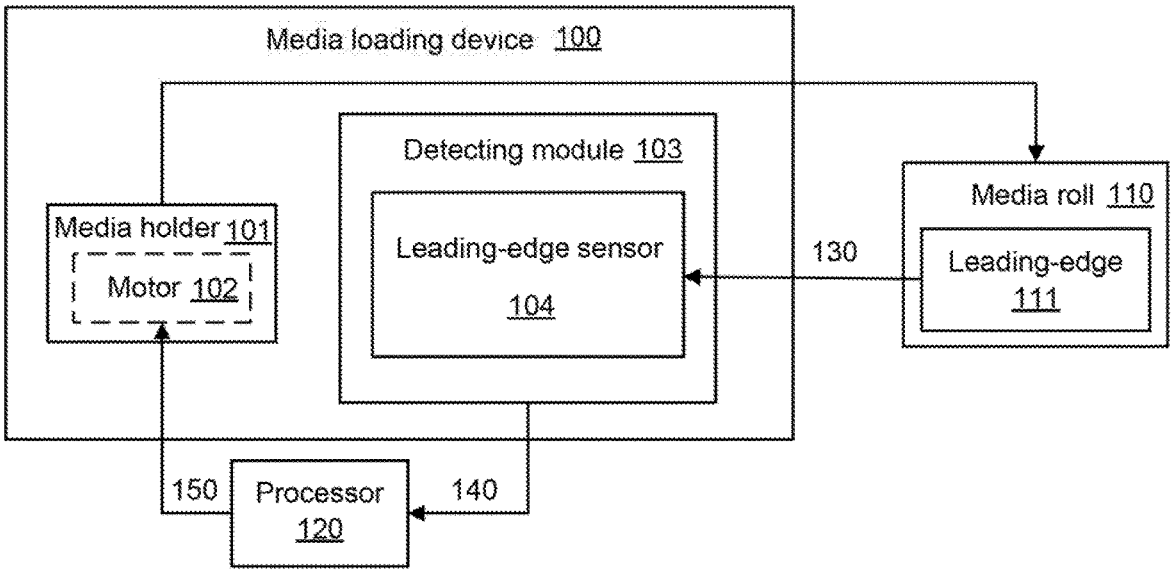
FIG. 1 shows a media loading device comprising a leading-edge sensor, according to an example of the present disclosure.

For simplicity and illustrative purposes, the present disclosure is described by referring mainly to examples. In the following description, numerous specific details are set forth in order to provide a thorough understanding of the present disclosure. It will be readily apparent, however, that the present disclosure may be practiced without limitation to these specific details. In other instances, some methods and structures have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

Disclosed herein are examples of media loading devices, methods, and systems which may be used to load a media. Hence, different examples of devices, methods, and systems are described.

A media loading device to receive a media-roll having a leading-edge according to an example may comprise a motor and a sensor to determine the leading-edge of the media roll, i.e., a leading-edge sensor. The motor may rotate the media roll in a winding direction and unwinding direction, and the motor may be controlled by a processor. Further, the leading-edge sensor may comprise a pivot arm and a detecting element wherein the pivot arm may contact the media roll and the detecting element may protrude from below the pivot arm as to contact the leading-edge of the media roll as it separates from the body of the media roll. Upon detection of the leading edge, the detecting element may issue a leading-edge presence signal to the processor upon contact with the leading-edge and a contacting surface.

In an example, the detecting element of the media loading device may be positioned to contact the leading-edge of the media roll as the media roll rotates in the winding direction.

In other examples, the detecting element of the media loading device may be positioned remotely to the media roll so that there is no contact between the detecting element and the leading-edge while the media roll rotates in the unwinding direction.

According to other examples, the detecting element may comprise a rolling element and a sensor. The rolling element may contain the contacting surface to contact the leading-edge and the sensor may detect a rotation of the rolling element. The contact between the rolling element and the leading-edge may cause the rotation of the rolling element and the sensor may issue the leading-edge presence signal to the processor based on the detection. In other examples, the rolling element may be a toothed element, wherein a tooth of the toothed element may be the contacting surface. The tooth may have different geometries to contact the leading-edge of the media roll.

In other examples, the media loading device may further comprise a radius detector. The radius detector may issue a radius signal to the processor, the radius signal being associated to a radius of the media roll. The processor may set an angular speed of the motor based on the radius signal issued by the radius detector. In other examples, the media loading device may further comprise a pinch arm biased against the media roll. The radius detector may be located on one of the pivot arm or the pinch arm. The radius detector may contact the media roll and may issue the radius signal to the processor. The pivot arm and the pinch arm may adjust a media path for the leading-edge when the media roll rotates.

Throughout the foregoing description, the winding direction of the media roll will be referred to as a direction in which the media roll is rolled. Accordingly, the unwinding direction of the media roll will be referred to as a direction opposite to the winding direction, in which the media roll is unrolled.

Moreover, the term leading-edge will be used to refer to a forward part of the media roll which is moved outwards from the perimeter of the media roll, i.e., the free edge of the media that will be unwind from the roll to perform, e.g., a printing operation.

Also, it is hereby disclosed a loading method that comprises several actions to load a media roll. The loading method may comprise a motor to rotate a media holder in a winding direction and an unwinding direction wherein the media holder is to receive a media roll having a leading-edge. The method may further comprise a leading-edge sensor comprising a detector and a pivot arm. The pivot arm may contact the media roll, and the leading-edge sensor issues a leading-edge signal to a processor upon contact between the detector and the leading-edge, for example the contact may cause a rotation of the detector. The contact may occur while the motor rotates in the winding direction. The processor may control the motor upon signal reception.

In an example, the loading method may further comprise a radius detector to determine a radius of the media roll. Upon the radius is determined, a radius signal may be issued to the processor and the processor may modify an angular speed of the motor based on the radius signal. In other examples, the loading method may further comprise a pinch arm biased against the media roll and the radius detector may be located on one of the pivot arm or the pinch arm. The radius detector may contact the media roll and the processor may set the angular speed of the motor based on the radius signal.

In other examples, the loading method may modify the angular speed of the motor so that a media roll tangential speed is within a speed range. The media roll tangential speed may be determined from, at least, the radius signal and the motor angular speed.

In other examples, the loading method may further comprise a series of presence sensors to detect the leading-edge along a media path. Each, of the sensors issues a media path signal to the processor upon the detection of the leading-edge during rotation of the motor in the unwinding direction. If the media path signals are not received by the processor before a predefined time assigned to each of the presence sensors, the processor may stop the motor. In an example, the predefined time may be assigned through a look-up table. In other examples, the predefined time may be assigned through a mathematical function. The mathematical function may comprise parameters such as a leading-edge speed, a radius of the media roll, distance between sensors, and corrections. The leading-edge speed is defined as the linear speed of the leading-edge, i.e., the angular speed of the media roll multiplied by the radius of the media roll. The mathematical function may be different for each segment between the presence sensors, i.e., between successive sensors the corrections or the distance factors may be different.

According to an example, a printing system having a print zone may comprise a media holder, a motor, a processor and a leading-edge sensor. The media holder is to receive a media roll having a leading-edge, wherein the media holder is rotated by the motor in a winding direction and an unwinding direction. The processor controls the motor and the leading-edge sensor comprises a pivot arm to contact the media roll and a detecting element protruding from below the pivot arm. Upon contact between the detecting element and the leading-edge, a leading-edge presence signal may be issued to the processor while the motor rotates in the winding direction. The processor may reverse the rotation to an unwinding direction upon receipt of the leading-edge presence signal. The rotation in the unwinding direction may cause the leading-edge to move through a media path to the print zone.

In an example, the printing system may further comprise a series of presence sensors along the media path, wherein each of the presence sensors issues a media path signal to the processor upon detection of the leading-edge. Whether the media path signal is not received before a predefined time assigned to each of the presence sensors, the processor stops the motor. In an example, the predefined time may be assigned be assigned through a mathematical function. The mathematical function may comprise parameters such as a leading-edge speed, a radius of the media roll, distance between sensors, and corrections. The leading-edge speed is defined as the linear speed of the leading-edge, i.e., the angular speed of the media roll multiplied by the radius of the media roll. The mathematical function may be different for each segment between the presence sensors, i.e., between successive sensors the corrections or the distance factors may be different.

In other examples, the printing system may further comprise a radius detector to determine a radius of the media roll. The radius detector may issue a radius signal to the processor upon the radius determination and the processor may modify an angular speed of the motor based on the radius signal.

Referring now to FIG. 1, a media loading device 100 may comprise a leading-edge sensor 104 to detect a leading-edge 111 of a media roll 110. The media loading device 100 may comprise a detecting module 103 and a media holder 101 to receive a media roll 110. The detecting module 103 may comprise the leading-edge sensor 104.

To detect the leading edge, a motor 102 rotates the media holder 101 in a winding direction and an unwinding direction. The rotation transmission from the motor 102 to the media holder 101 may be accomplished by adding by mechanical means, e.g., a belt, a gearbox, or any other mechanical arrangement to transfer a rotational force from the motor towards the media roll. The detecting module 103 issues a leading-edge presence signal 140 to a processor 120 upon a contact 130 between the leading-edge 111 and the leading-edge sensor 104. The processor 120 may control the motor 102 upon the reception of the leading-edge presence signal 140. The control may be included in a motor signal 150, which may cause the motor 102 to perform actions, e.g. stopping the motor, reversing the motor or changing the motor speed. In some examples, the leading-edge sensor 104 may comprise a detecting element and a pivot arm, wherein the pivot arm is to contact the media roll 110. The pivot arm may rotate around a point so that the pivot arm keeps contacting the media roll 110 as it rotates. The detecting element may protrude from below the pivot arm.

Figure 2:
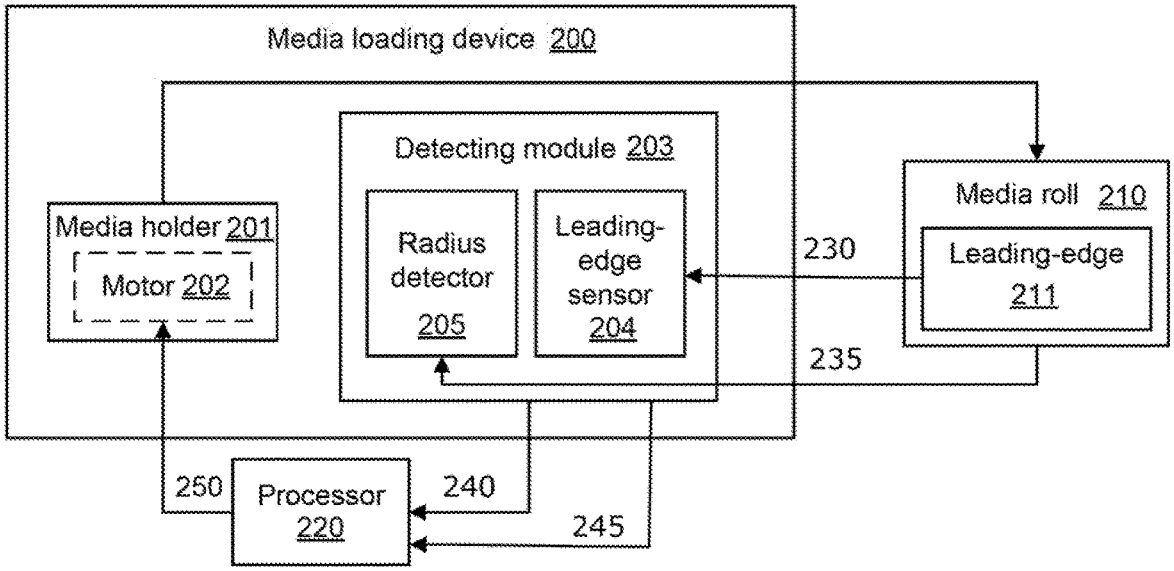
FIG. 2 shows a media loading device comprising a leading-edge sensor and a radius detector, according to an example of the present disclosure.

Referring now to FIG. 2, a media loading device 200 may comprise a media holder 201 and a detecting module 203. The detecting module 203 may comprise a leading-edge sensor 204 and a radius detector 205. The media holder 201 is to receive a media roll 210 having a leading-edge 211. The leading-edge sensor 204 may detect the leading-edge 211 upon a contact 230 occurs between the leading-edge 211 and the leading-edge sensor 204. The motor 202 is to rotate the media roll, e.g., by rotating the media holder 201. The media holder 201 rotates in a winding direction and an unwinding direction. The motor 202 may be controlled by a motor signal 250 issued by a processor 220. As in the example of FIG. 1, upon a contract 230 between the leading-edge sensor 204 and the leading-edge 211, a leading-edge presence signal 240 is sent to the processor. Also, the radius detector 205 measures a radius of the media roll 210 and issues a radius signal 245 to the processor 220. The leading edge-presence signal 240 and the radius signal 245 may be issued by the detecting module 203 to the processor 220. The processor 220 may control the motor 202 upon reception of the signals through a motor signal 250. In an example, the radius detector 205 determines the radius of the media roll periodically. The motor signal 250 may cause the motor 202 to perform actions, e.g. stopping the motor, reversing the direction of rotation or changing the rotation speed.

In an example, the leading-edge sensor comprises a detecting element, a sensor, and a pivot arm to contact the media roll. The pivot arm may be pivotable and biased towards the media holder so that, in use, it contacts the media roll. The detecting element may protrude from below the pivot arm and may have a contacting surface. The sensor may detect contact between the detecting element and the leading-edge and, upon such contact, a leading-edge presence signal is issued to the processor. In other examples, the pivot arm may further comprise a radius detector to determine a radius of the media roll while contacting the media roll.

In an example of radius detector, such detector is located in a pinch arm. The pinch arm may be a pivotable arm to contact the media roll in a contact area, the pinch arm to adjust a media path to a leading-edge in conjunction with the pivot arm. The pinch arm may contact the media roll in a lower position than the pivot arm. The radius detector may contact the media roll to determine a radius. In an example, the radius detector may comprise a rotating element to reduce the friction during the contact. The rotating element of the radius detector may have the same tangential speed as the media roll. The rotating, element does not slip during the rotation, as a consequence, a media roll tangential speed is the same for the rotating element and the media roll.

In a further example, the rotation of the rotating element may be used by a sensor to determine an angular speed, e.g., the sensor may be used to calculate a rate of rotation. Since the rotating element has a known radius, the tangential speed of the media roll and the rotating element may be calculated. Also, a radius of the media roll may be calculated based on the tangential speed of the media roll and an angular speed of the motor. In an example, the angular speed of the motor may be known or may be calculated in view of the motor speed and/or the energy supply sent to the motor. In an example, the radius detector determines the radius of the media roll periodically. In other examples, the radius detector determination may comprise measuring an angular displacement of the rotating element in a time elapsed, i.e., a rate of rotation. The radius of the media roll may also be calculated by using a predetermined angular speed instead of calculating it.

In other examples the pivot arm may include both the radius detector and the leading-edge sensor and the pinch arm is provided to adjust the media path to the leading-edge of the media roll.

In other examples, the radius detector may be located remotely to the media roll. The radius detector may measure the radius of the media roll by optical means. A radius signal may be sent to the processor upon a radius determination, the radius signal including the radius of the media roll. An adjusted angular speed of the motor may be calculated from the radius signal issued by the radius detector.

Figure 3:
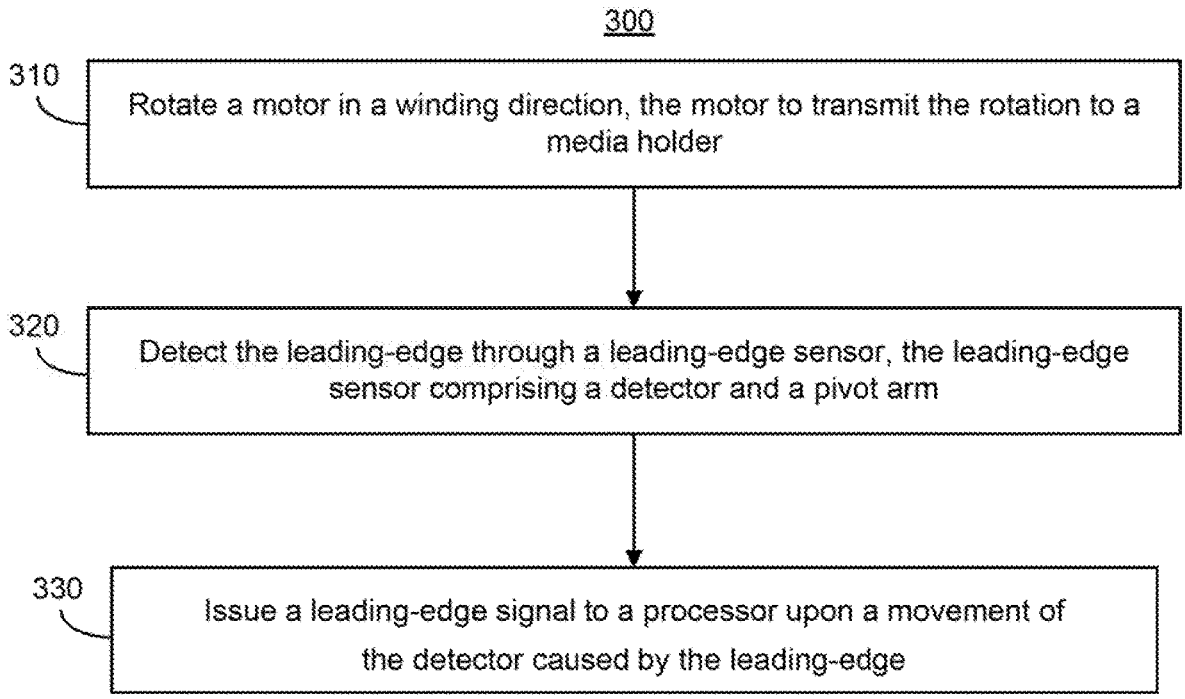
FIG. 3 shows a loading method comprising several actions, according to an example of the present disclosure.

Referring now to FIG. 3, a loading method 300 may comprise actions to load media. The loading method may comprise rotating a motor in a winding direction as to rotate a media holder, wherein the media holder is to receive a media roll having a leading-edge. During the rotation in the winding direction, the leading-edge is detected by a leading-edge sensor, the leading-edge sensor comprising a detector and a pivot arm. In particular, the pivot arm contacts the media roll and the leading-edge sensor issues a leading-edge signal to a processor upon a movement of the detector caused by the leading-edge during rotation of the motor in the winding direction.

In an example, the loading method may further comprise a radius detector to determine a radius of the media roll. The radius detector issues a radius signal to the processor upon determining a radius of the media roll. The processor may modify an angular speed of the motor based on the radius signal.

In other examples, the loading method may further comprise a pinch arm biased towards the media roll, wherein the radius detector is located at the pinch arm. The radius detector may be alternatively comprised in the pivot arm.

Figure 4:
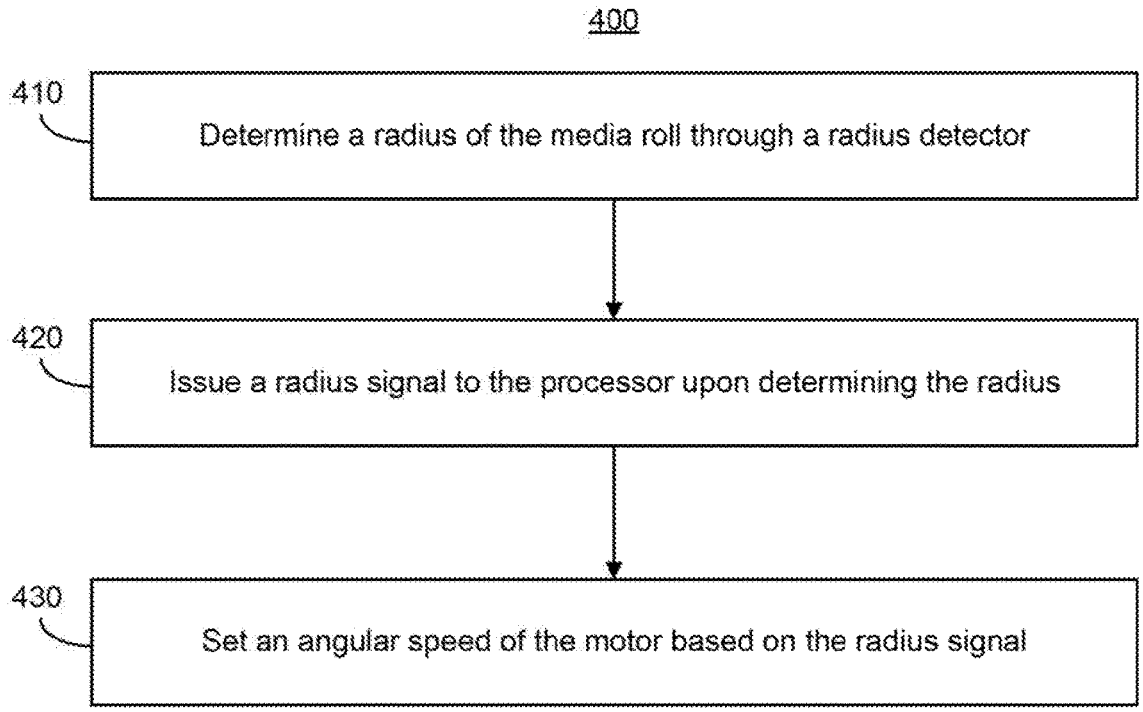
FIG. 4 shows a loading method comprising the detection of the radius of the media roll and using the radius detection to adjust an angular speed of a motor, according to an example of the present disclosure.

Referring to FIG. 4, a radius detector method 400 to measure the radius of the media roll is shown. The radius detector may measure a radius of the media roll by mechanical or optical means. Upon the radius is determined, a radius signal is sent to the processor. The processor sets an angular speed of the motor based on the radius signal. The processor calculates an appropriate value of an angular speed based on parameters. In one example, the parameters may comprise a media roll thickness, a motor rotation direction, a type of material or the current state of the loading. The angular speed of the motor is adjusted through a polynomial function comprising some of the parameters. In other examples, the radius detector method comprises or has access to a table with preferred angular speeds depending on the radius. The processor may have access to a memory when the table is stored. If needed, the table may be updated with new values. The radius detector method 400 may be applied to loading methods 300 which may use the radius detectors described previously in the description.

In an example, the radius of the media roll may be calculated from a radius signal. The radius signal may enable to calculate the media roll tangential speed. From the media roll tangential speed and a motor angular speed the processor may calculate the radius of the media roll. If the media roll tangential speed is within a speed range the angular speed of the motor is maintained. On the other hand, if the tangential speed of the media roll is outside the speed range, the angular speed of the motor may be adjusted. The ranges in other examples may be applied to media roll radius, wherein radius ranges may determine if and adjustment of the motor angular speed is needed. In an example, the adjustment may be performed applying a ratio value to the angular speed of the motor, the ratio value being calculated between the media roll tangential speed and predefined values.

Figure 5:
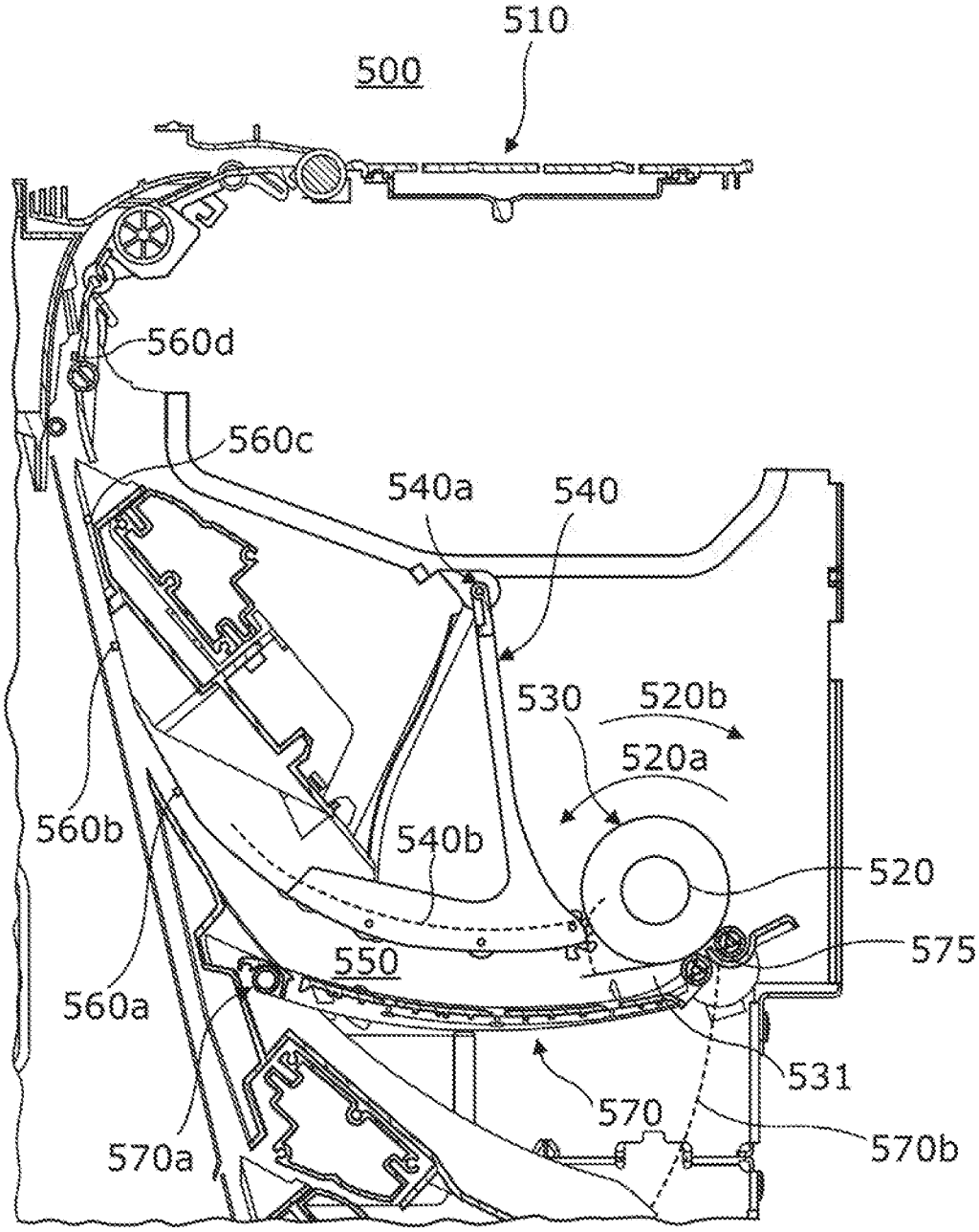
FIG. 5 shows a printing system having a print zone and a media loading device, according to an example of the present disclosure.

Referring now to FIG. 5, a printing system 500 having a print zone 510 may comprise a media holder 520, a motor, a processor, and a leading-edge sensor 540. The motor (not shown in FIG. 5) can rotate the media holder 520 (and, therefore, a media roll associated to the media holder) in a winding direction 520*a* and in an unwinding direction 520*b*, the media holder 520 being to support a media roll 530.

The leading-edge sensor 540 contacts the media roll 530 in a contacting area, the leading-edge sensor 540 to detect a leading-edge 531 of the media roll 530. The leading-edge sensor 540 can pivot around a point 540*a* so that the leading-edge sensor may move along a trajectory 540*b*. Upon contact between the leading-edge 531 and the leading-edge sensor 540 during rotation in the winding direction 520*a*, a leading-edge presence signal is issued to the processor (not shown in FIG. 5). Once the leading-edge presence signal is received by the processor, the processor may reverse the rotation to an unwinding direction 520*b*. The rotation in the unwinding direction 520*b* may cause the leading-edge 531 to move through a media path 550 to the print zone 510.

The example of FIG. 5 also discloses optional elements which may be located within the printing system 500, such as a radius detector 575 and a series of presence sensors (560*a*, 560*b*, 560*c*, 560*d*) along the media path 550. The radius detector 575 may be attached to a pinch arm 570, the pinch arm 570 being pivotable around a second point 570*a* as to move along a trajectory 570*b*. Alternatively, a radius detector 575 can determine a radius of the media roll 530 by optical means, without having the pinch arm 570.

In the example of FIG. 5, the radius detector 575 contacts the media roll 530. The radius detector 575 issues a radius signal to the processor upon radius determination. The radius detector 575 may use, for example, the radius detector method of FIG. 4.

The processor may adjust an angular speed of the media holder 520 by modifying an angular speed of the motor based on the radius signal. In addition to the radius signal issued by the radius detector 575, the series of presence sensors (560*a*, 560*b*, 560*c*, 560*d*) may issue a media path signal to the processor. The media path signal may be issued upon the leading-edge 531 is detected by each of the presence sensors. Whether a media path signal is not received by the processor before a predefined time, the processor may stop the motor. The predefined times may be assigned for each of the presence sensors independently. In other examples, the number of presence sensors along the media path 550 may be different than four. The predefined times for each of the presence sensors may be set based on a polynomial function of system parameters or defined values.

In an example, the processor adjusts the angular speed of the motor based on data extracted from a look-up table (LUT). The LUT may include predefined radius values linked with angular speed values for the motor. By comparing the radius signal with the predefined radius values, the angular speed of the motor may be adjusted. Other printing system characteristics may be included as variables in the LUT, such as a media thickness, a media holder rotation direction, a type of material or the current state of the printing system. In an example, for the same radius signal, different angular speeds may be set whether the media holder is rotating in the winding direction or the unwinding direction. In other examples, a coated media may need a different angular speed adjustment than an uncoated media.

In other examples, the processor may adjust the angular speed of the motor through a polynomial function, the function comprising parameters such as a radius of the media roll, a type of media, a media thickness, a state of the system, a motor rotation direction, and current angular speed. However, other parameters may be possible. The polynomial function may re-calculate the angular speed of the motor periodically.

Figure 6A:
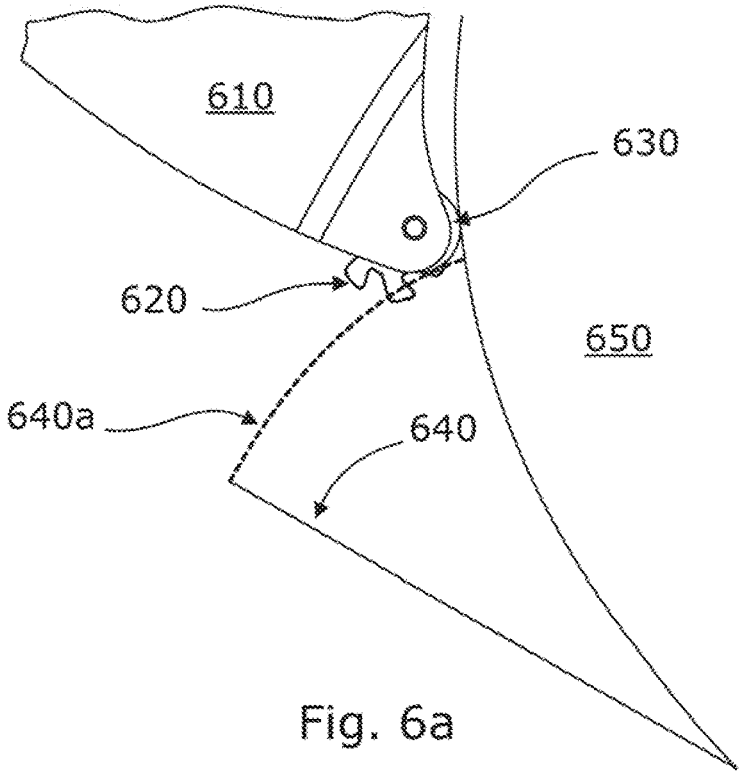
FIG. 6*a* shows a leading-edge sensor comprising a rolling element and a detecting element, according to an example of the present disclosure.

Referring now to FIG. 6*a*, a leading-edge sensor may comprise a pivot arm 610 and detecting element. The detecting element may comprise a rolling element 620 and a sensor. The leading-edge sensor is to contact a media roll 650 through a contacting element 630, the leading-edge sensor to issue a radius signal upon detecting a leading-edge 640 of the media roll 650. The contacting element 630 may allow to reduce the friction between the leading-edge sensor and the media roll 650. The leading-edge 640 during a rotation in a winding direction may describe a leading-edge trajectory 640*a* so that a contact between the leading-edge 640 and a contacting surface of the rolling element 620 may occur. The rotation of the rolling element 620 may be detected by the sensor (not shown in FIG. 6*a*). The sensor may measure the rotation of the rolling element 620 by optical means, such as an encoder. In other examples, the leading-edge sensor does not include the element 630 and the pinch arm contacts directly the media roll 650.

Figure 6B:
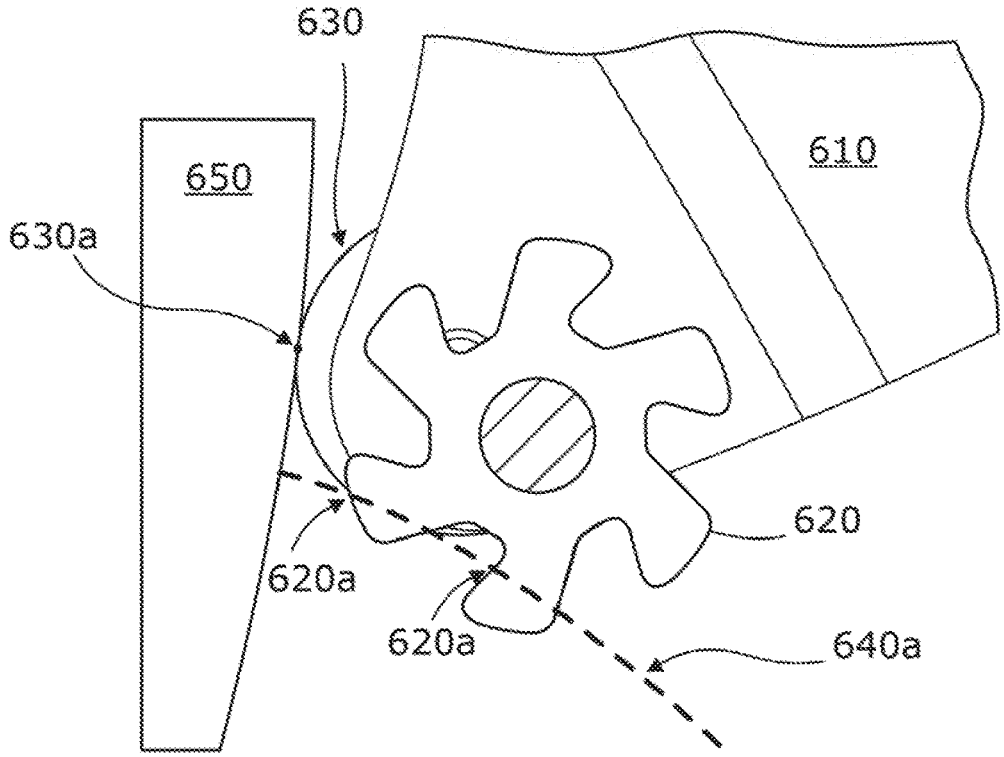
FIG. 6*b* shows a rear view of the leading-edge sensor of the FIG. 6*a*, according to an example of the present disclosure.

Referring now to FIG. 6*b*, a rear view of the leading-edge sensor of FIG. 6*a* is represented. The contact surface 630*a* of the leading-edge sensor is the area wherein the media roll 650 and the contacting element 630 contact. Since the contacting element 630 of the example of FIG. 6*a* is circular, a distance between the rolling element 620 and the media roll 650 is obtained. The rolling element 620 in the example of FIG. 6*b* protrudes from below the pivot arm 610, however, other locations may be possible. In other examples the rolling element 620 and the contacting element 630 may have the same rotation axis. The leading-edge trajectory 640*a* may intersect the rolling element 620 in the contacting surfaces 620*a*. Upon contact between the contacting surface 620*a* and the leading-edge 640 occurs, a leading-edge signal is issued to the processor. The contact may be determined by a sensor (not shown in FIG. 6*b*), the sensor to issue the leading-edge signal to the processor when a movement of the rolling element 620 occurs.

What has been described and illustrated herein are examples of the disclosure along with some variations. The terms, descriptions, and figures used herein are set forth by way of illustration only and are not meant as limitations. Many variations are possible within the scope of the disclosure, which is intended to be defined by the following claims (and their equivalents) in which all terms are meant in their broadest reasonable sense unless otherwise indicated.

The invention claimed is:

1. A media loading device to receive a media roll having a leading-edge, the media loading device comprising:

a motor to rotate the media roll in a winding direction and an unwinding direction, being the motor to be controlled by a processor; a leading-edge sensor comprising:

a pivot arm to contact the media roll; and, a detecting element protruding from below the pivot arm, the detecting element having a contacting surface and being to issue a leading-edge presence signal to the processor upon contact with the leading edge, wherein the detecting element comprises a rolling element having the contacting surface and the detecting element comprises a sensor to detect a rotation of the rolling element, wherein the contact with the leading edge causes the rotation of the rolling element, and wherein the sensor is to issue the leading-edge presence signal to the processor based on the detection.

2. The media loading device of claim 1, wherein the detecting element is positioned to contact the leading edge as the media roll rotates in the winding direction.

3. The media loading device of claim 1, wherein the detecting element is positioned remotely to the media roll so that there is no contact with the leading edge while the media roll rotates in the unwinding direction.

4. The media loading device of claim 1, wherein the rolling element is a toothed element, wherein a tooth of the toothed element is the contacting surface.

5. A media loading device to receive a media roll having a leading-edge, the media loading device comprising:

a motor to rotate the media roll in a winding direction and an unwinding direction, being the motor to be controlled by a processor; a leading-edge sensor comprising:

a pivot arm to contact the media roll;

a detecting element protruding from below the pivot arm, the detecting element having a contacting surface and being to issue a leading-edge presence signal to the processor upon contact with the leading edge; and a radius detector, the radius detector to issue a radius signal associated to a radius of the media roll to the processor, and wherein the processor sets an angular speed of the motor based on the radius signal.

6. The media loading device of claim 5 further comprising a pinch arm biased against the media roll, wherein the radius detector is located on one of the pivot arm or the pinch arm, wherein the radius detector contacts the media roll and issues the radius signal to the processor, the pinch arm and the pivot arm to adjust a media path for the leading-edge when the media roll rotates.

7. A loading method comprising:

a motor to rotate a media holder in a winding direction and an unwinding direction, the media holder to receive a media roll having a leading-edge;

a processor to control the motor;

a leading-edge sensor comprising a detector and a pivot arm, the pivot arm being to contact the media roll, wherein the leading-edge sensor issues a leading-edge signal to the processor upon a movement of the detector caused by the leading-edge while the motor rotates in the winding direction; and a radius detector to determine a radius of the media roll, wherein a radius signal is issued to the processor upon determining the radius, wherein the processor is to modify an angular speed of the motor based on the radius signal.

8. The loading method of claim 7, further comprising a pinch arm biased against the media roll 1 wherein the radius detector is located on one of the pivot arm or the pinch arm, the radius detector to contact the media roll and the processor to set the angular speed of the motor based on the radius signal.

9. The loading method of claim 7, wherein the angular speed of the motor is modified so that a media roll tangential speed is within a speed range, wherein the media roll tangential speed is determined from, at least, the radius signal and the motor angular speed.

10. A loading method comprising:

a motor to rotate a media holder in a winding direction and an unwinding direction, the media holder to receive a media roll having a leading-edge;

a processor to control the motor;

a leading-edge sensor comprising a detector and a pivot arm, the pivot arm being to contact the media roll, wherein the leading-edge sensor issues a leading-edge signal to the processor upon a movement of the detector caused by the leading-edge while the motor rotates in the winding direction; and a series of presence sensors to detect the leading-edge along a media path, wherein each of the presence sensors has assigned a predefined time, wherein each of the sensors issue a media path signal to the processor upon the detection of the leading-edge during a rotation of the motor in the unwinding direction, wherein the processor stops the motor if the media path signal is not received before the predefined time corresponding to each of the sensors.

* * * * *